US010582829B2

(12) United States Patent
Hansen et al.

(10) Patent No.: US 10,582,829 B2
(45) Date of Patent: Mar. 10, 2020

(54) DISHWASHER WITH VERTICALLY ADJUSTABLE DISH RACK

(71) Applicant: Whirlpool Corporation, Benton Harbor, MI (US)

(72) Inventors: Matthew Martin Kenneth Hansen, Saint Joseph, MI (US); Ronald M. Nowell, Jr., Saint Joseph, MI (US); Richard Lawrence Kretz, Findlay, OH (US); Kapil Gupta, Maharashtra (IN); Darryl C. Bodine, Saint Joseph, MI (US); Jerry M. Visin, Benton Harbor, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/797,647

(22) Filed: Oct. 30, 2017

(65) Prior Publication Data

US 2019/0125161 A1 May 2, 2019

(51) Int. Cl.
*A47L 15/50* (2006.01)
*A47L 15/46* (2006.01)
(Continued)

(52) U.S. Cl.
CPC ..... *A47L 15/506* (2013.01); *A47L 15/16* (2013.01); *A47L 15/22* (2013.01);
(Continued)

(58) Field of Classification Search
CPC ..... A47L 15/16; A47L 15/22; A47L 15/44; A47L 15/46; A47L 15/506; A47L 15/507;
(Continued)

(56) References Cited

U.S. PATENT DOCUMENTS 5,657,878 A * 8/1997 Austin ..... A47L 15/504 211/208
5,860,716 A * 1/1999 Good ..... A47L 15/504 312/311

(Continued)

FOREIGN PATENT DOCUMENTS

EP 0033483 A2 8/1981
KR 101366286 B1 6/2009
WO 2017114630 A1 7/2017

*Primary Examiner* — James O Hansen
(74) *Attorney, Agent, or Firm* — McGarry Bair PC

(57) ABSTRACT

A dishwasher includes a tub at least partially defining a treating chamber, at least one dish rack in the treating chamber, and a rack height adjustment assembly. The rack height adjustment assembly includes an adjuster plate slidably coupled to the at least one dish rack and fixed vertically relative to the tub, the adjuster plate including at least one adjuster detent, a locking lever having a catch end that is biased to engage the adjuster detent to hold the dish rack in place in either a lowered or raised position, the locking lever being pivotally movable relative to the at least one dish rack between an engaging position where the catch end engages the adjuster detent and a release position where the catch end does not engage the adjuster detent and the dish rack is vertically movable between the lowered and raised positions, and an actuator configured to move the locking lever to the release position when the actuator is moved from an undepressed position to a depressed position.

20 Claims, 7 Drawing Sheets

(51) Int. Cl.

| | |
|---|---|
| ***A47L 15/42*** | (2006.01) |
| ***A47L 15/16*** | (2006.01) |
| ***A47L 15/44*** | (2006.01) |
| ***A47L 15/22*** | (2006.01) |

(52) U.S. Cl.
CPC ..... *A47L 15/4219* (2013.01); *A47L 15/4225* (2013.01); *A47L 15/4285* (2013.01); *A47L 15/4293* (2013.01); *A47L 15/44* (2013.01); *A47L 15/46* (2013.01); *A47L 15/507* (2013.01)

(58) Field of Classification Search
CPC ..... A47L 15/4219; A47L 15/4225; A47L 15/4285; A47L 15/4293

USPC ..... 312/228, 228.1, 311

See application file for complete search history.

(56) References Cited

U.S. PATENT DOCUMENTS

| | | | | |
|---|---|---|---|---|
| 7,168,578 | B2 | 1/2007 | Mersch et al. | |
| 7,410,228 | B2 | 8/2008 | Dickson et al. | |
| 7,418,967 | B2 | 9/2008 | Kim | |
| 7,424,893 | B2 | 9/2008 | Kim | |
| 8,813,766 | B2 * | 8/2014 | Bhajak | A47L 15/504 134/135 |
| 2004/0103932 | A1 * | 6/2004 | Kim | A47L 15/504 134/137 |
| 2008/0011337 | A1 * | 1/2008 | Ryu | A47L 15/504 134/147 |
| 2008/0272072 | A1 * | 11/2008 | Tynes | A47L 15/504 211/41.8 |
| 2011/0018410 | A1 | 1/2011 | Bastuji et al. | |
| 2012/0082507 | A1 * | 4/2012 | Wong | A47L 15/504 403/17 |
| 2014/0145573 | A1 * | 5/2014 | Cox | A47L 15/507 312/228.1 |
| 2017/0086646 | A1 | 3/2017 | Kim et al. | |

* cited by examiner

DISHWASHER WITH VERTICALLY ADJUSTABLE DISH RACK

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes. The dishwasher can be provided with a door, which can be pivotally mounted to the tub, that closes the open front. The at least one rack or basket can be provided in the form of upper and lower dish racks. The upper and lower dish racks can be separated by a defined vertical spacing that limits the overall size of items that can be placed in the dishwasher.

In order to provide more flexibility to users, adjustment assemblies can be provided that enable at least one dish rack to be vertically adjustable. Most commonly, the upper dish rack can be vertically shifted to increase or decrease the defined vertical spacing between the upper and lower dish racks. Typically, the adjustment assemblies are mounted on opposing sides of the dish rack and connect to support rails that permit the dish rack to move in and out of the treating chamber. Such adjustment assemblies can have complicated structure, can be difficult to operate in transitioning from one height position to another, are unstable and/or are simply not reliable.

BRIEF SUMMARY

In one aspect, illustrative embodiments in accordance with the present disclosure relate to a dishwasher including a tub at least partially defining a treating chamber, at least one dish rack in the treating chamber, and a rack height adjustment assembly. The rack height adjustment assembly includes an adjuster plate slidably coupled to the at least one dish rack and fixed vertically relative to the tub, the adjuster plate including at least one adjuster detent, a locking lever having a catch end that is biased to engage the adjuster detent to hold the dish rack in place in either a lowered or raised position, the locking lever being pivotally movable relative to the at least one dish rack between an engaging position where the catch end engages the adjuster detent and a release position where catch end does not engage the adjuster detent and the dish rack is vertically movable between the lowered and raised positions, an actuator configured to move the locking lever to the release position when the actuator is moved from an undepressed position to a depressed position, and a biasing element biasing the actuator to the undepressed position when the actuator is not depressed.

In another aspect, illustrative embodiments in accordance with the present disclosure relate to a method of adjusting a dish rack supported for selective movement between lowered and raised positions within a dishwasher tub, the method including moving an actuator from an undepressed position to a depressed position wherein a locking lever pivots from an engaging position where the dish rack is held in place to a release position where the dish rack is vertically movable between lowered and raised positions, and biasing the actuator by a biasing element to an undepressed position when the actuator is not depressed.

DETAILED DESCRIPTION OF EMBODIMENTS OF THE INVENTION

Figure 1:
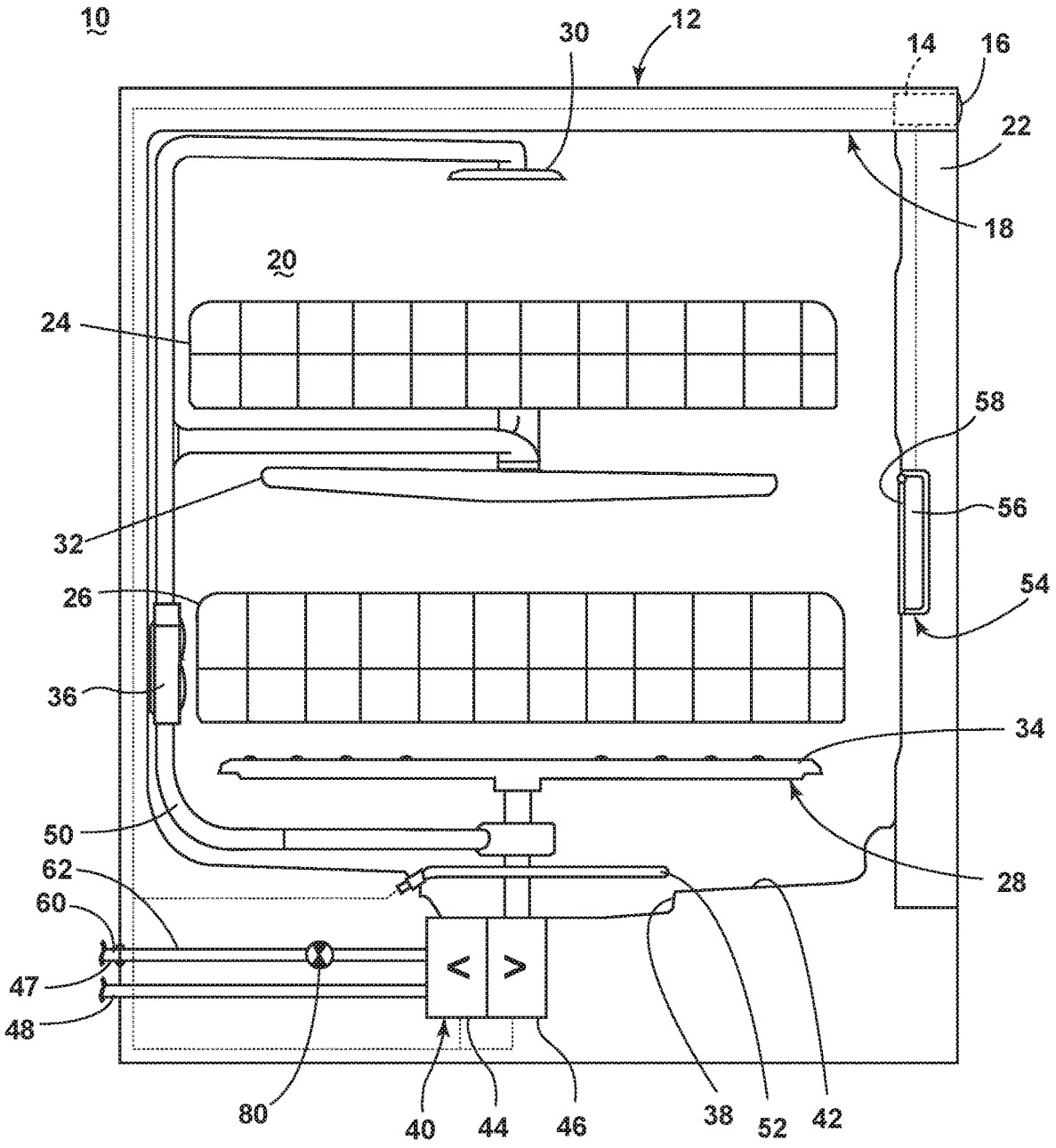
FIG. 1 illustrates a schematic, side view of a dishwasher according to an embodiment of the present disclosure.

FIG. 1 is a schematic, side view of a dishwasher 10 for treating dishes according to an automatic cycle of operation, according to an embodiment of the present disclosure. In FIG. 1, the dishwasher 10 includes a chassis 12 defining an interior. Depending on whether the dishwasher 10 is a stand-alone or built-in dishwasher, the chassis 12 can be a frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it can also be implemented in other types of dishwashing units, such as in-sink dishwashers, multi-tub dishwashers, or drawer-type dishwashers.

A controller 14 can be located within the chassis 12 and can be operably coupled with various components of the dishwasher 10 to implement one or more cycles of operation. A control panel or user interface 16 can be provided on the dishwasher 10 and coupled with the controller 14. The user interface 16 can be provided on the chassis 12 or on the outer panel of the door 22 and can include operational controls such as dials, lights, switches, and displays enabling a user to input commands, such as a cycle of operation, to the controller 14 and receive information about the selected cycle of operation.

A tub 18 is located within the interior of and mounted to the chassis 12 and at least partially defines a treating chamber 20 with an access opening in the form of an open face. A cover, illustrated as a door 22, can be hingedly or pivotally mounted to the chassis 12 and can selectively move between an opened position, wherein the user can access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door 22 or a third level rack above the upper rack 24 can also be provided.

A spraying system 28 can be provided for spraying liquid into the treating chamber 20 and is illustrated in the form of an upper sprayer 30, a mid-level sprayer 32, a lower sprayer 34, and a spray manifold 36. The upper sprayer 30 can be located above the upper rack 24 and is illustrated as a fixed spray nozzle that sprays liquid downwardly within the treating chamber 20. Mid-level sprayer 32 and lower sprayer 34 are located beneath upper rack 24 and lower rack 26, respectively, and are illustrated as rotating spray arms. The mid-level sprayer 32 can provide a liquid spray upwardly through the bottom of the upper rack 24. The lower sprayer 34 can provide a liquid spray upwardly through the bottom of the lower rack 26. The mid-level sprayer 32 can optionally also provide a liquid spray downwardly onto the lower rack 26, but for purposes of simplification, this will not be illustrated herein.

The spray manifold 36 can be fixedly mounted to the tub 18 adjacent to the lower rack 26 and can provide a liquid spray laterally through a side of the lower rack 26. The spray manifold 36 is not limited to this position; rather, the spray manifold 36 can be located in any suitable part of the treating chamber 20. While not illustrated herein, the spray manifold 36 can include multiple spray nozzles having apertures configured to spray wash liquid towards the lower rack 26. The spray nozzles can be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety. Instead of or in addition to the spray manifold 36 provided on the rear wall, nozzles can be provided on the right and left side walls of the tub 18.

A liquid recirculation system can be provided for recirculating liquid from the treating chamber 20 to the spraying system 28. The recirculation system can include a sump 38 and a pump assembly 40. The sump 38 collects the liquid sprayed in the treating chamber 20 and can be formed by a sloped or recess portion of a bottom wall 42 of the tub 18. The pump assembly 40 can include both a drain pump 44 and a recirculation pump 46.

The liquid recirculation system can also be fluidly coupled with a water supply line 47 for receiving fresh water from a water supply source, such as a household water supply, as well as a water supply circuit. The water supply circuit comprises a household inlet fitting 60, which is carried by the chassis 12, a conduit 62 that fluidly couples the inlet fitting 60 to the tub 18, and an actuatable valve 80. The actuatable valve 80 selectively controls the flow of liquid through the conduit 62, allowing the flow of liquid from the conduit 62 into the tub 18 when the actuatable valve 80 is in an opened position, and preventing the flow of liquid from the conduit 62 into the tub 18 when the actuatable valve 80 is in a closed position.

The drain pump 44 can draw liquid from the sump 38 and pump the liquid out of the dishwasher 10 to a household drain line 48. The recirculation pump 46 can draw liquid from the sump 38 and pump the liquid through the spray system 28 to supply liquid into the treating chamber 20 through a supply tube 50 to one or more of the sprayers 30, 32, 34, 36. In this manner, liquid can circulate from the sump 38 through the liquid recirculation system to the spray system 28 and back to the sump 38 to define a liquid recirculation circuit or flow path.

While the pump assembly 40 is illustrated as having separate drain and recirculation pumps 44, 46 in an alternative embodiment, the pump assembly 40 can include a single pump configured to selectively supply wash liquid to either the spraying system 28 or the drain line 48, such as by configuring the pump to rotate in opposite directions, or by providing a suitable valve system.

A heating system having a heater 52 can be located within or near the sump 38 for heating liquid contained in the sump 38. The heater 52 can also heat air contained in the treating chamber 20. Alternatively, a separate heating element (not shown) can be provided for heating the air circulated through the treating chamber 20. A filtering system (not shown) can be fluidly coupled with the recirculation flow path for filtering the recirculated liquid.

A user-accessible dispensing system can be provided for storing and dispensing one or more treating chemistries to the treating chamber 20. As shown herein, the user-accessible dispensing system can include a dispenser 54 mounted on an inside surface of the door 22 such that the dispenser 54 is disposed in the treating chamber 20 when the door 22 is in the closed position. The dispenser 54 is configured to dispense treating chemistry to the dishes within the treating chamber 20. The dispenser 54 can have one or more compartments 56 closed by a door 58 on the inner surface of the door 22. The dispenser 54 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser.

The dispenser 54 can further be configured to hold multiple different treating chemistries. For example, the dispenser 54 can have multiple compartments defining different chambers in which treating chemistries can be held. While shown as being disposed on the door 22, other locations of the dispenser 54 are possible. However, the dispenser 54 is positioned to be accessed by the user for refilling of the dispenser 54, whether it is necessary to refill the dispenser 54 before each cycle (i.e. for a single user dispenser) or only periodically (i.e. for a bulk dispenser).

Figure 2:
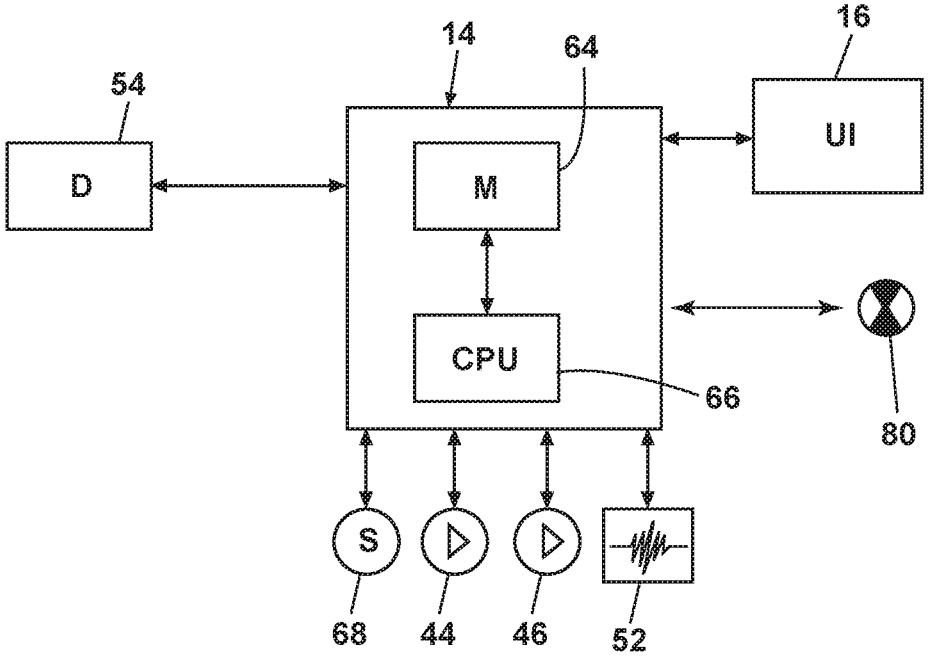
FIG. 2 illustrates a schematic view of a controller for use with the dishwasher of FIG. 1.

FIG. 2 is a schematic view of the controller 14 of the dishwasher 10 of FIG. 1. As illustrated schematically in FIG. 2, the controller 14 can be coupled with the heater 52 for heating the wash liquid during a cycle of operation, the drain pump 44 for draining liquid from the treating chamber 20, the recirculation pump 46 for recirculating the wash liquid during the cycle of operation, the user-accessible dispenser 54 for selectively dispensing treating chemistry to the treating chamber 20, and the actuatable valve 80 to selectively control the flow of liquid through the conduit 62 into the tub 18.

The controller 14 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step or a combination thereof. These multiple steps can also be performed by the dishwasher 10 in any desired combination.

The controller 14 can also receive input from one or more sensors 68. Non-limiting examples of sensors 68 that can be communicably coupled with the controller 14 include a temperature sensor and turbidity sensor to determine the soil load associated with a selected grouping of dishes, such as the dishes associated with a particular area of the treating chamber 20.

Figure 3:
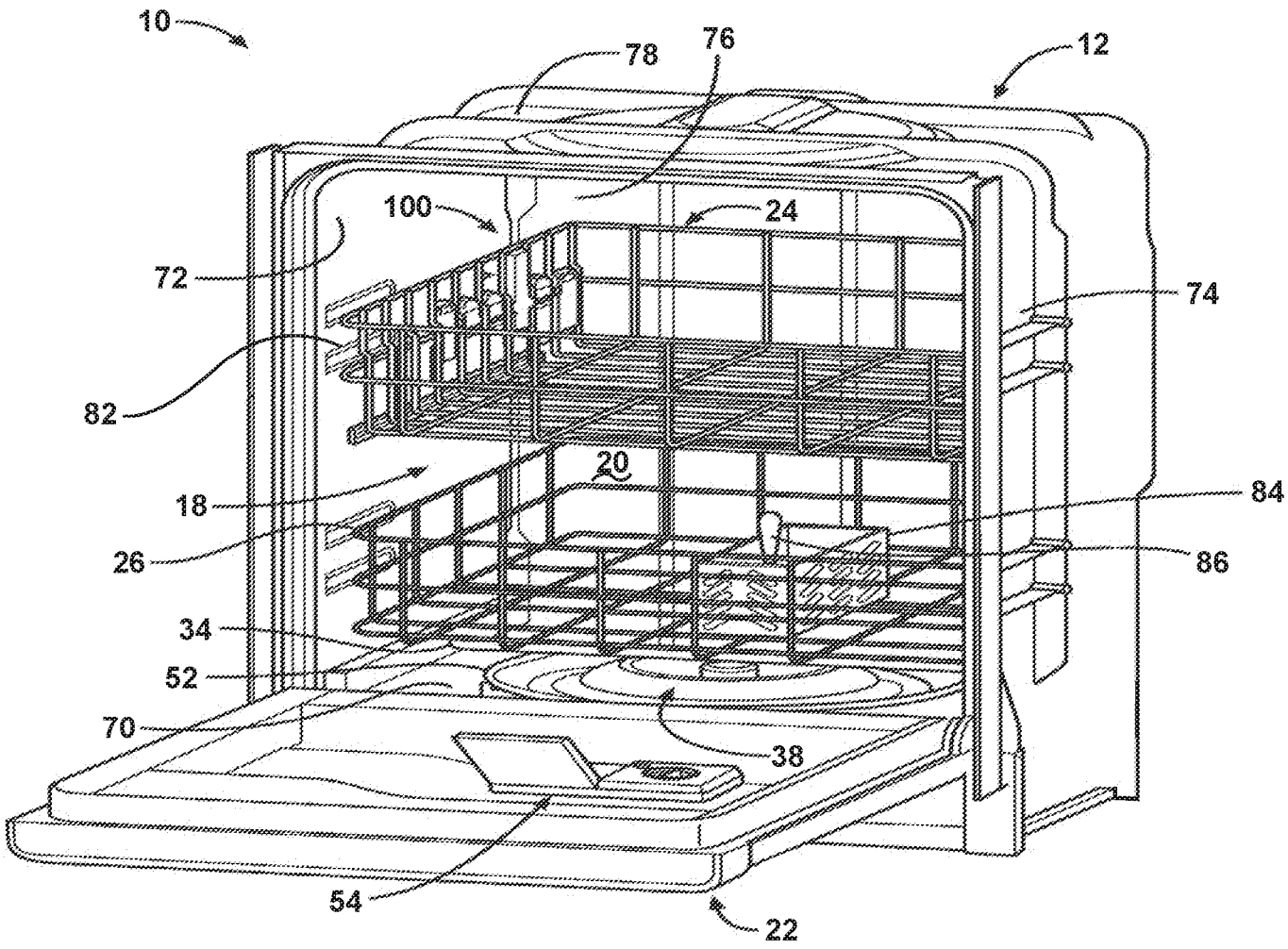
FIG. 3 illustrates a perspective view of the dishwasher of FIG. 1 including a dish rack having a rack height adjustment assembly in accordance with an embodiment of the present disclosure.

Turning now to FIG. 3, a perspective view of the dishwasher 10 is illustrated. The tub 18, which, by way of non-limiting example, can be injection molded of plastic, can include a bottom wall 70, side walls 72, 74, rear wall 76, and a top wall 78. The upper rack 24 can be coupled to the side walls 72, 74 for slidable movement relative thereto via support rails 82. A utensil basket 84, which contains a utensil 86, can be positioned within the lower rack 26, or at any other suitable location within the dishwasher 10. Further, at least one of the upper rack 24 or the lower rack 26 can be vertically adjustable relative to the tub 18 via a rack height adjustment assembly 100. In an exemplary embodiment, the rack height adjustment assembly 100 can include two rack height adjustment assemblies 100 provided at opposing sides of the upper rack 24 for vertically shifting the upper rack 24 between a first or lowered position and a second or raised position. While the upper rack 24 is illustrated herein as being vertically adjustable and including the rack height adjustment assembly 100, it will be understood that the lower rack 26 can include the rack height adjustment assembly 100, either instead of or in addition to the upper rack 24.

Figure 4:
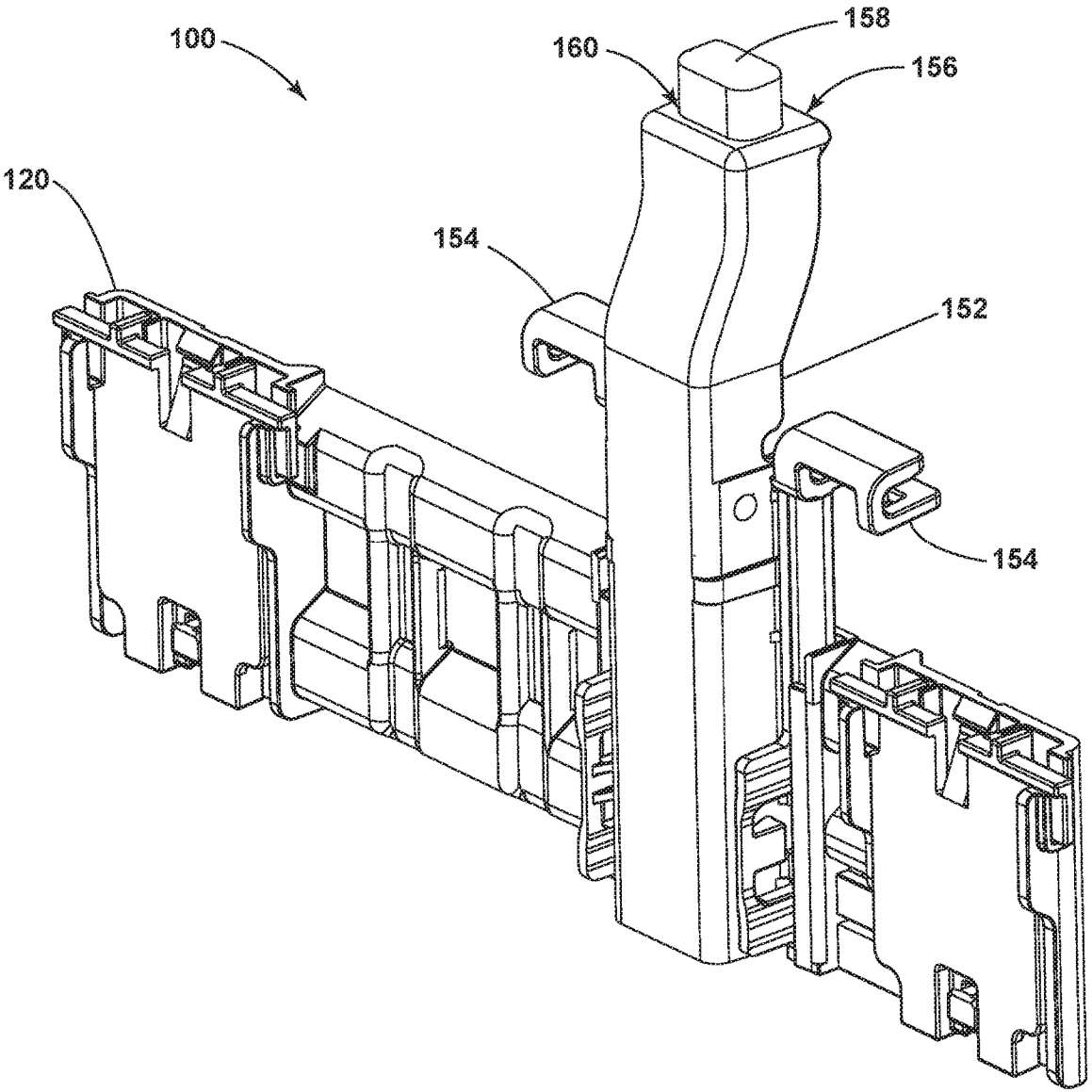
FIG. 4 illustrates a perspective view of the rack height adjustment assembly of FIG. 3 according to an embodiment of the present disclosure.

FIG. 4 illustrates a perspective view of the rack height adjustment assembly 100 according to an embodiment of the present disclosure. The rack height adjustment assembly 100 can include an adjuster plate 120 that can be coupled with the support rail 82 such that it is at least partially withdrawable from the tub 18 along with the upper rack 24, while also being vertically stationary relative to the tub 18. The rack height adjustment assembly 100 includes a housing 152 comprising rack couplers 154 that allow the rack height adjustment assembly 100 to be coupled to the upper rack 24. Any suitable number of rack couplers 154 can be included, and can be configured to couple the housing 152 to vertical or horizontal wires of the upper rack 24, or to both the vertical and the horizontal wires. In an exemplary embodiment, the housing 152 is coupled to the upper rack 24 such that vertical movement relative to the upper rack 24 is not permitted, but horizontal movement along the upper rack 24 can optionally be permitted. An actuator 158 protrudes through an actuator opening 160 in an upper surface 156 of the housing 152.

Figure 5:
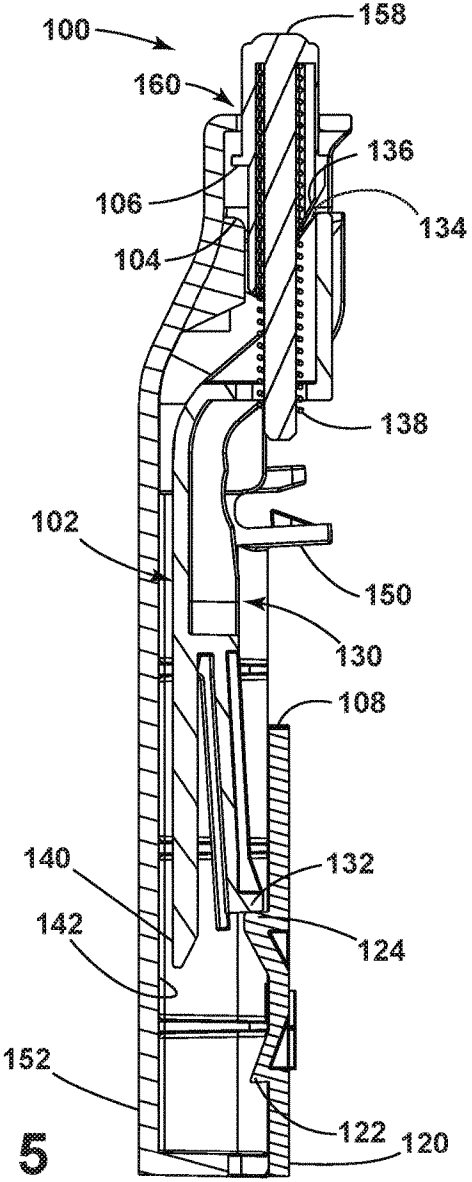
FIG. 5 illustrates a cross-sectional side view of the rack height adjustment assembly of FIG. 4 in a raised position and with a locking lever in an engaging position according to a first embodiment of the present disclosure.

FIG. 5 illustrates a cross-sectional side view of the rack height adjustment assembly 100 corresponding to the raised position of the upper rack 24. The actuator 158 includes an angled lower surface 136 that is positioned adjacent to an angled upper surface 134 of a locking lever 130. The actuator 158 is slidably vertically movable relative to the housing 152 between an undepressed position, as shown in FIG. 5, and a depressed position shown in FIG. 6. The actuator 158 can be optionally provided with an actuator spring 138 that can serve as a biasing element and apply an upward pressure to the actuator 158, such that the actuator spring 138 biases the actuator 158 toward the undepressed position. An actuator flange 106 bears against the actuator opening 160 when the actuator 158 is in the undepressed position to prevent further upward movement of the actuator 158.

The locking lever 130 is pivotally movable relative to both the housing 152 and relative to the upper rack 24 about a pivot point 102. In an exemplary embodiment, the pivot point 102 can be located near the vertical midpoint of the locking lever 130. The locking lever 130 further comprises a lever flange 140. The lever flange 140 protrudes horizontally outwardly from the locking lever 130 relative to the pivot point 102. In an exemplary embodiment, the lever flange 140 extends outwardly towards an inner surface 142 of the housing 152, the inner surface 142 being opposed to the adjuster plate 120. The lever flange 140 can have some flexibility or compressibility relative to the locking lever 130. In an exemplary embodiment, the lever flange 140 serves as a biasing element and exerts an outward force against the inner surface 142 of the housing 152, which biases the locking lever 130 to a substantially vertical, non-pivoted position as shown in FIG. 5.

The locking lever 130 further comprises a catch end 132 that selectively engages with the adjuster plate 120 to define an engaging position and a release position of the locking lever 130. Specifically, the adjuster plate includes an upper detent 124 and a lower detent 122. As shown in FIG. 5, the catch end 132 of the locking lever 130 rests on top of the upper detent 124 of the adjuster plate 120. The locking lever 130 is in the engaging position as the catch end 132 is engaged with the upper detent 124. Further, when the catch end 132 rests on top of the upper detent 124, the upper rack 24 is held in the raised position relative to the adjuster plate 120. While the rack height adjustment assembly 100 is illustrated herein as including two detents, the upper and lower detents 124, 122, corresponding to the raised and lowered position of the upper rack 24, it will be understood that any suitable number of detents can be included to correspond to any suitable number of positions of the upper rack 24. By way of non-limiting example, the adjuster plate 120 can be provided with three, four, or more detents such that the upper rack 24 can be selectively moved between three, four, or more pre-determined vertical positions relative to the tub 18.

Figure 6:
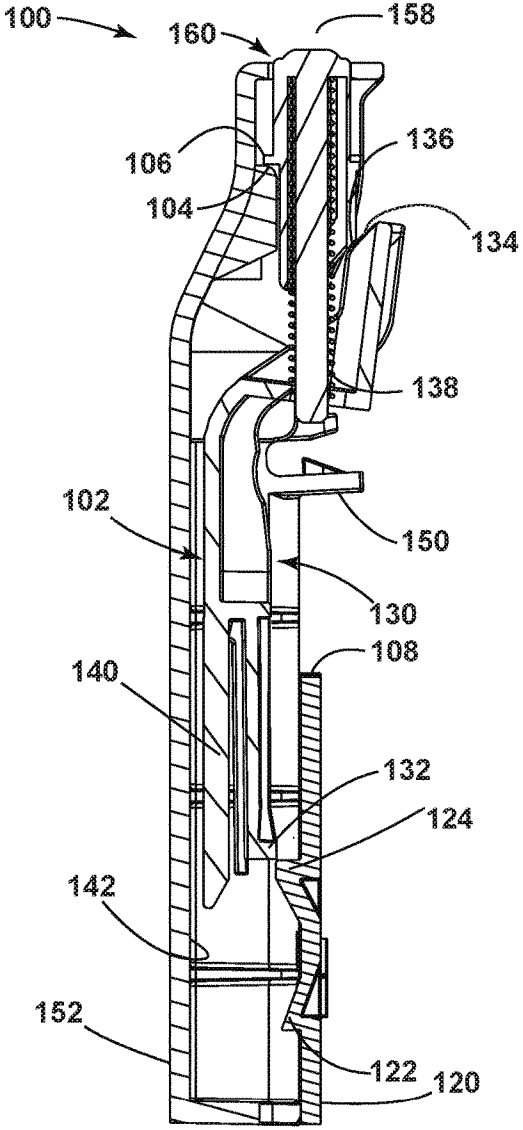
FIG. 6 illustrates the rack height adjustment assembly of FIG. 5 in the raised position with the locking lever in a release position.

FIG. 6 illustrates the locking lever 130 in the release position relative to the adjuster plate 120. The actuator 158 is in the depressed position, such that the actuator flange 106 has been moved downwardly until it contacts a housing ledge 104, which prevents further downward movement of the actuator 158. The lower angled surface 136 of the actuator 158 contacts and has moved downwardly against the upper angled surface 134 of the locking lever 130. The locking lever 130 is shown in a pivoted position, such that the upper angled surface 134 has pivoted away from the actuator 158 and the catch end 132 is pivoted inwardly from the adjuster plate 120, towards the inner surface 143. The catch end 132 is not resting on the upper detent 124 and is not restricted from vertical movement by the adjuster plate 120. In this release position, the rack height adjustment assembly 100, and also the upper rack 24 to which the rack height adjustment assembly 100 is coupled, can be vertically movable relative to the adjuster plate 120 and relative to the tub 18.

Figure 7:
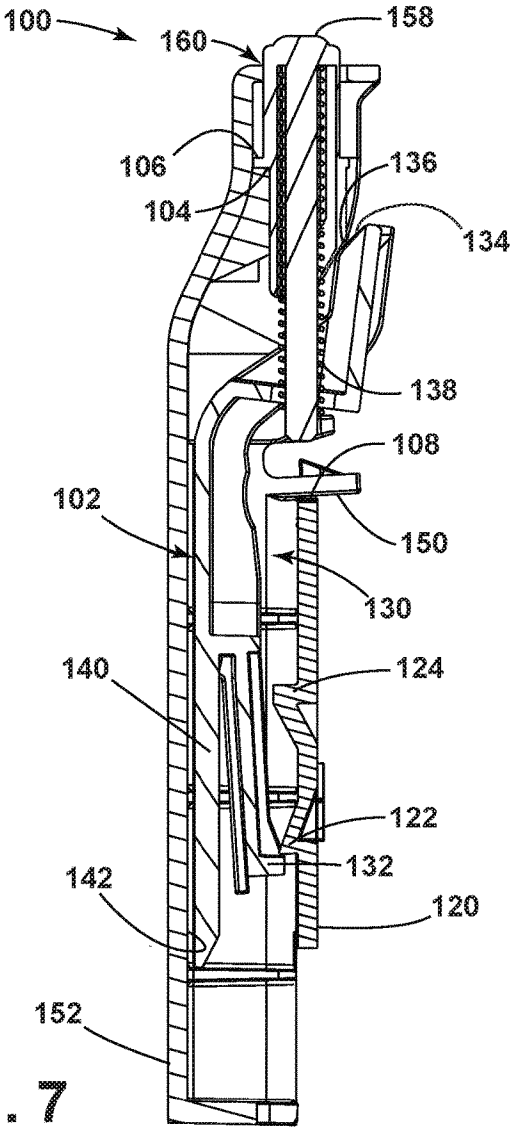
FIG. 7 illustrates the rack height adjustment assembly of FIG. 5 in a lowered position and with the locking lever in the release position.

FIG. 7 illustrates the actuator 158 and the locking lever 130 in the same depressed position and release position, respectively, as shown in FIG. 6, but with the rack height adjustment assembly 100 and the upper rack 24 now in the lowered position relative to the adjuster plate 120. When the rack height adjustment assembly 100 and the upper rack 24 are in the lowered position, a housing flange 150 contacts and rests on top of an upper surface 108 of the adjuster plate 120. When the housing flange 150 rests on top of the upper surface 108, further downward movement of the rack height adjustment assembly 100 and the upper rack 24 are prevented.

Figure 8:
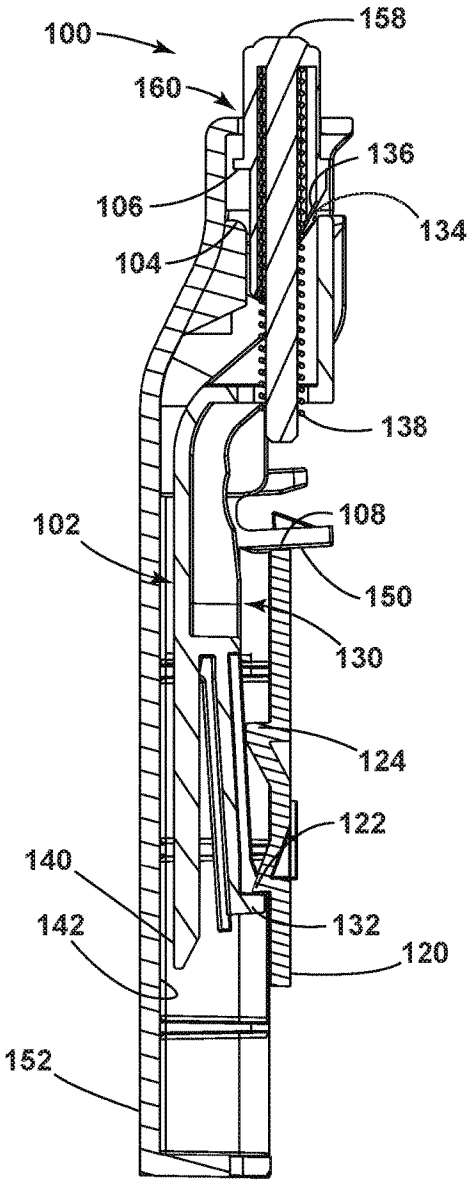
FIG. 8 illustrates the rack height adjustment assembly of FIG. 5 in the lowered position and with the locking lever in the engaging position.

FIG. 8 illustrates the rack height adjustment assembly 100 and the upper rack 24 in the lowered position, with the actuator 158 in the undepressed position and the locking lever 130 in the non-pivoted position and in the engaging position relative to the adjuster plate 120. In the engaging position with the upper rack 24 in the lowered position, the catch end 132 rests beneath the lower detent 122 of the adjuster plate 120, preventing upward movement of the rack height adjustment assembly 100 and the upper rack 24. The housing flange 150 resting on top of the upper surface 108 of the adjuster plate 120 prevents further downward movement, so the rack height adjustment assembly 100 and the upper rack 24 are locked from vertical movement in either the upward or the downward direction. The vertical distance between the housing flange 150 and the catch end 132 is selected to correspond to the vertical distance between the upper detent 124 and the lower detent 122 such that when the rack height adjustment assembly 100 is in the lowered position with the actuator 158 in the undepressed position and the locking lever in the engaging position, vertical movement is prohibited and the upper rack 24 is locked in place vertically in a stable manner such that vertical rattling movement is prevented.

Turning now to the operation of the rack height adjustment assembly 100, a user can depress the actuator 158 in order to allow for selective vertical movement of the upper rack 24 between the lowered and raised positions within the tub 18. In an exemplary embodiment, the upper rack 24 can include at least two rack height adjustment assemblies 100, in opposing positions and corresponding to the side walls 72, 74 of the tub 18. However, it will be understood that the upper rack 24 can be provided with only a single rack height adjustment assembly 100 on a single side of the upper rack 24. The user can depress the actuator 158 by grasping the upper rack 24 and using either a thumb or a palm of a hand to depress the actuator 158.

When the user has depressed the actuator 158 as shown in FIGS. 6-7, the lower angled surface 136 of the actuator 158 is pushed downward against the upper angled surface 134 of the locking lever 130. The locking lever 130 is not vertically movable relative to the housing 152, so the downward pressure applied by the lower angled surface 136 of the actuator 158 causes an upper portion of the locking lever 130, specifically the upper angled surface 134 of the locking lever 130, to pivot outwardly, away from the actuator 158. As the locking lever 130 pivots about the pivot point 102, the catch end 132 is pivoted in the opposite direction, away from the adjuster plate 120 and toward the inner surface 142, causing the locking lever 130 to move from the engaging position to the release position relative to the adjuster plate 120. At the same time, the pivoting of the locking lever 130, particularly of the catch end 132 away from the adjuster plate 120, causes the lever flange 140 to be compressed towards the catch end 132 against the inner surface 142. When the actuator 158 is depressed and the locking lever 130 is in the release position, the user can then raise or lower the upper rack 24 to either the raised or the lowered position, respectively.

When the user has depressed the actuator 158, released the locking lever 130, and moved the upper rack 24 vertically to the desired position of either the raised position or the lowered position, the user can release the actuator 158 so that the actuator 158 returns to the undepressed position. The force provided by one or more biasing elements can cause the actuator 158 to return to the undepressed position when the user is no longer depressing the actuator 158. For example, the lever flange 140 acts as a biasing element because of the compression force between the inner surface 142 and the lever flange 140. The lever flange exerts an outward force against the inner surface 142 which biases the locking lever 130 to the non-pivoted position, which in turn biases the angled upper surface 134 toward the actuator 158, creating an upward pressure against the angled lower surface 136 and urging the actuator 158 to return to the undepressed position.

Additionally, actuator spring 138 can provide further upward pressure to bias the actuator 158 to the undepressed position. In embodiments with the actuator spring 138 present, the actuator spring 138 can contribute to providing a more rapid and smooth return of the actuator 158 to the undepressed position. However, it will be understood that the actuator spring 138 is not required to be present within the rack height adjustment assembly 100. In embodiments where the actuator spring 138 is not included, the biasing force provided by the lever flange 140 is sufficient to cause the actuator 158 to be returned to and biased to the undepressed position, regardless of whether the upper rack 24 is in the raised or the lowered position. In an exemplary embodiment, the actuator 158 can be formed from a low friction material in order to accommodate smooth movement of the actuator 158 from the depressed to the undepressed position when a user is no longer depressing the actuator 158. Non-limiting examples of such a material include nylon or polyoxymethylene (POM).

Figure 10:
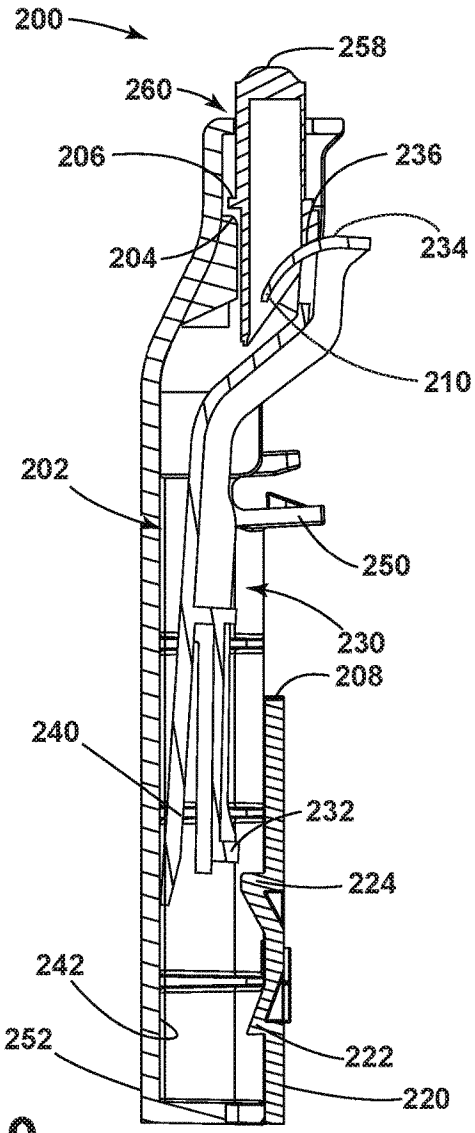
FIG. 10 illustrates the rack height adjustment assembly of FIG. 9 in the raised position and with the locking lever in the release position.
Figure 9:
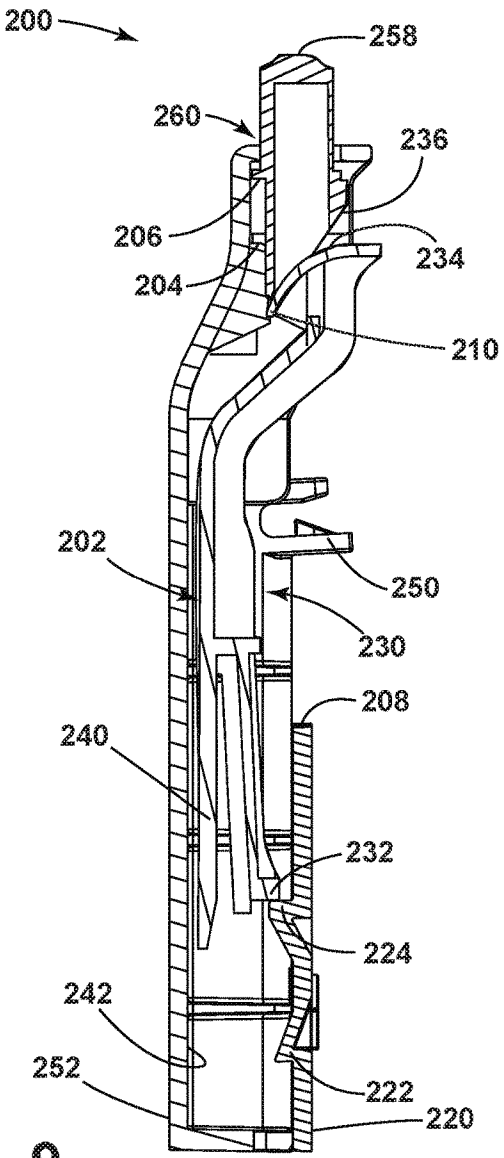
FIG. 9 illustrates a cross-sectional side view of the rack height adjustment assembly of FIG. 4 in the raised position and with the locking lever in the engaging position according to another embodiment of the present disclosure.

FIGS. 9-10 illustrate another embodiment of the present disclosure comprising a rack height adjustment assembly 200, which is similar to the first rack height adjustment assembly 100, except for the structure and function of the upper angled surface 134 of the locking lever 130. Therefore, elements in the rack height adjustment assembly 200 similar to those of the first rack height adjustment assembly 100 will be numbered with the prefix 200, with it being understood that the description of the corresponding parts of the first embodiment applies to the second embodiment, unless otherwise noted. As the operation of the locking lever 230 relative to the adjuster plate 220 is essentially identical to that described with respect to the first embodiment in detail, the description of the operation will not be reiterated here.

FIG. 9 illustrates a cross-sectional view of the rack height adjustment assembly 200 with the actuator 258 in the undepressed position and the locking lever 230 in the non-pivoted position and in the engaging position with respect to the adjuster plate 220. The lower angled surface 236 of the actuator 258 is adjacent to, but not deflecting, a flat spring head 234 of the locking lever 230. The flat spring head 234 is similar to the angled upper surface 134 of the locking lever 130, except that the angle of the flat spring head 234 can differ from that of the angled upper surface 134, and the flat spring head 234 further includes a flat spring flange 210 that is at least partially deflectable.

FIG. 10 illustrates the rack height adjustment assembly 200 with the actuator 258 in the depressed position and the locking lever 230 in the pivoted position and in the release position with respect to the adjuster plate 220. The actuator is depressed and applies a downward force to the flat spring head 234 and to the flat spring flange 210, to at least partially deflect the flat spring flange 210. Due to the deflection, the flat spring flange 210 thus applies an upward force against the angled lower surface 236 of the actuator 258.

Turning now to the operation of the rack height adjustment assembly 200, when the actuator 258 is depressed, the operation of the rack height adjustment assembly 200 is identical to that described for the first embodiment, with the depression of the actuator 258 resulting in pivoting of the locking lever 230 and causing the release of the catch end 232 from the adjuster plate 220, moving the locking lever 230 from the engaging position to the release position such that a user can vertically adjust the upper rack 24 between the raised and the lowered position. When the user releases the actuator 258, the lever flange 240 serves as a biasing element to bias the actuator 258 back to the undepressed position, as described previously.

In addition, the flat spring head 234 and the flat spring flange 210 act as an additional biasing element to urge the actuator 258 back to the undepressed position. Just as the actuator spring 138 can be optionally provided in the first embodiment, the flat spring head 234 and the flat spring flange 210 can be provided in the second embodiment to aid in returning the actuator 258 to the undepressed position. Because the downward movement of the actuator 258 exerts a downward force against the flat spring head 234 and at least partially deflects the flat spring flange 210, the flat spring flange 210 also exerts an upward force against the actuator 258 as the flat spring flange 210 is biased to return to an original, undeflected position. When the depressing force applied by a user is no longer applied to the actuator 258, the flat spring flange 210 exerts pressure against the angled lower surface 236 of the actuator 258, providing additional biasing force to cause the actuator 258 to return to the undepressed position.

The embodiments described herein can be used to provide an adjustment assembly for the vertical height of a dish rack to allow selective vertical repositioning of the dish rack between at least a raised and a lowered position in a user-friendly and simple manner, while maintaining stability of the dish rack. The actuator allows for ease of use by a user and increased comfort by providing the option of using either a thumb or a palm of the hand to depress the actuator. In addition, it is easy for a user to tell when the actuator is fully depressed so the user knows it is possible and safe to then vertically adjust the dish rack. Further still, when the dish rack is vertically adjusted to the lowered position and is held in the engaging position, vertical movement in either the downward or the upward direction is prevented, resulting in a very stable hold of the dish rack. This can be ideal for transporting, shipping, delivering, and assembling of the dishwasher as the dish rack can be safely held in a secure manner, preventing rattling of parts or undesired movement of the dish rack during transport.

It will also be understood that various changes and/or modifications can be made without departing from the spirit of the present disclosure. By way of non-limiting example, although the present disclosure is described for use with a wire dish rack, it will be recognized that the rack height adjustment assembly can be employed with various rack constructions, including molded racks, such as racks molded of plastic.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber;

at least one dish rack in the treating chamber; and a rack height adjustment assembly comprising:

an adjuster plate slidably coupled to the at least one dish rack and fixed vertically relative to the tub, the adjuster plate including at least one adjuster detent;

a locking lever having a catch end that is biased to engage the adjuster detent to hold the dish rack in place in either a lowered or raised position, the locking lever being pivotally moveable relative to the at least one dish rack between an engaging position where the catch end engages the adjuster detent and a release position where the catch end does not engage the adjuster detent and the dish rack is vertically movable between the lowered and raised positions;

an actuator configured to move the locking lever to the release position when the actuator is moved from an undepressed position to a depressed position; and a biasing element biasing the actuator to the undepressed position when the actuator is not depressed;

wherein a downward movement of the actuator against the locking lever biases an upper portion of the locking lever radially outwardly and causes the locking lever to pivot relative to the dish rack, releasing the catch end from engagement with the adjuster detent.

2. The dishwasher of claim 1 wherein a second biasing element further biases the actuator to the undepressed position, the second biasing element comprising a spring that is coupled to the actuator.

3. The dishwasher of claim 1 wherein the biasing element is a flat spring head.

4. The dishwasher of claim 3 wherein the flat spring head is formed as an upper surface of the locking lever.

5. The dishwasher of claim 1 wherein the biasing element is a lever flange extending from the locking lever.

6. The dishwasher of claim 5 wherein the rack height adjustment assembly further comprises a housing that at least partially contains the locking lever and the actuator.

7. The dishwasher of claim 6 wherein the lever flange exerts an outward force against the housing.

8. The dishwasher of claim 1 wherein the adjuster plate includes at least a first and a second adjuster detent.

9. The dishwasher of claim 8 wherein the first and second adjuster detents correspond to the lowered and raised positions of the at least one dish rack.

10. The dishwasher of claim 1 wherein the at least one dish rack can be locked into the lowered position for shipping and transportation of the dishwasher.

11. A dishwasher comprising:

a tub at least partially defining a treating chamber;

at least one dish rack in the treating chamber; and a rack height adjustment assembly comprising:

an adjuster plate slidably coupled to the at least one dish rack and fixed vertically relative to the tub, the adjuster plate including at least one adjuster detent;

a locking lever having an upper angled surface and a catch end that is biased to engage the adjuster detent to hold the dish rack in place in either a lowered or raised position, the locking lever being pivotally moveable relative to the at least one dish rack between an engaging position where the catch end engages the adjuster detent and a release position where the catch end does not engage the adjuster detent and the dish rack is vertically movable between the lowered and raised positions;

an actuator having a lower angled surface and configured to move the locking lever to the release position when the actuator is moved from an undepressed position to a depressed position; and a biasing element biasing the actuator to the undepressed position when the actuator is not depressed;

wherein a downward movement of the lower angled surface of the actuator against the upper angled surface of the locking lever biases an upper portion of the locking lever radially outwardly and causes the locking lever to pivot relative to the dish rack, releasing the catch end from engagement with the adjuster detent.

12. The dishwasher of claim 11 wherein a second biasing element further biases the actuator to the undepressed position, the second biasing element comprising a spring that is coupled to the actuator.

13. The dishwasher of claim 11 wherein the biasing element is a flat spring head.

14. The dishwasher of claim 13 wherein the flat spring head is formed as an upper surface of the locking lever.

15. The dishwasher of claim 11 wherein the biasing element is a lever flange extending from the locking lever.

16. The dishwasher of claim 15 wherein the rack height adjustment assembly further comprises a housing that at least partially contains the locking lever and the actuator.

17. The dishwasher of claim 16 wherein the lever flange exerts an outward force against the housing.

18. The dishwasher of claim 11 wherein the adjuster plate includes at least a first and a second adjuster detent.

19. The dishwasher of claim 18 wherein the first and second adjuster detents correspond to the lowered and raised positions of the at least one dish rack.

20. The dishwasher of claim 11 wherein the at least one dish rack can be locked into the lowered position for shipping and transportation of the dishwasher.

* * * * *